US005799680A

United States Patent [19]

Dorflinger

[11] Patent Number: 5,799,680

[45] Date of Patent: Sep. 1, 1998

[54] CANOPY SYSTEM FOR OUTSIDE CONSTRUCTION

[76] Inventor: Russell C. Dorflinger, 62 Abbey Rd., East Hampton, Conn. 06424

[21] Appl. No.: 728,068

[22] Filed: Oct. 9, 1996

[51] Int. Cl.[6] ..... E04G 3/00; E04H 15/00

[52] U.S. Cl. ..... 135/96; 135/116; 135/117; 135/119; 135/120.3; 135/160; 52/DIG. 12; 52/90.2; 248/237

[58] Field of Search ..... 52/DIG. 12, 90.2; 135/87, 90, 96, 117, 119, 120.1, 120.2, 120.3, 116, 160, 155; 182/129; 160/127; 248/148, 237

[56] References Cited

U.S. PATENT DOCUMENTS

| | | | |
|---|---|---|---|
| 15,390 | 7/1856 | Rodefer . | |
| 298,463 | 5/1884 | Guedle . | |
| 379,734 | 3/1888 | Smith . | |
| 772,175 | 10/1904 | Palmer . | |
| 1,365,996 | 1/1921 | Herwick | 248/237 X |
| 2,618,285 | 11/1952 | Heisig | 135/120.2 X |
| 2,628,796 | 2/1953 | Krizman | 248/237 X |
| 2,714,387 | 8/1955 | Meldrum | 135/120.3 X |
| 2,777,454 | 1/1957 | Kramer . | |
| 2,865,386 | 12/1958 | Burns . | |
| 2,888,021 | 5/1959 | Adams . | |
| 3,091,056 | 5/1963 | La Porte . | |
| 3,303,851 | 2/1967 | Grunfeld | 135/120.3 X |
| 3,333,802 | 8/1967 | Goodman | 248/237 X |
| 3,425,428 | 2/1969 | Schwartz . | |
| 3,773,379 | 11/1973 | Loiseau | 135/119 X |
| 4,033,367 | 7/1977 | Johnston | 52/DIG. 12 |
| 4,631,878 | 12/1986 | Laramore | 52/90.2 |
| 4,730,423 | 3/1988 | Hughes | 135/87 X |
| 4,805,735 | 2/1989 | Anderson | 182/129 X |
| 5,261,435 | 11/1993 | Stanley et al. . | |
| 5,437,298 | 8/1995 | Lin . | |

FOREIGN PATENT DOCUMENTS

| | | | |
|---|---|---|---|
| 191104 | 8/1957 | Austria . | |
| 1110111 | 10/1954 | France . | |
| 1101706 | 3/1961 | Germany . | |
| 2909727 | 9/1980 | Germany . | |
| 862898 | 3/1961 | United Kingdom | 52/DIG. 12 |

*Primary Examiner*—Wynn E. Wood
*Attorney, Agent, or Firm*—DeLio & Peterson, LLC

[57] ABSTRACT

A canopy system for use when performing outside construction is provided. The canopy is particularly useful for use on a roof to protect the worker from rain, snow or sun and the canopy system comprises a plurality of adjustable brackets which are secured to the roof in spaced relation to form a desired canopy area, a plurality of rigid canopy support poles secured to the brackets and disposed in a substantially upright position, and a canopy member secured to the upper ends of the canopy support poles. A specially configured bracket is employed which comprises a rotatable and axially moveable member which member is fixedly positioned to a fixed member of the bracket and which moveable member is adapted to hold a canopy support pole in an upright position.

7 Claims, 2 Drawing Sheets

CANOPY SYSTEM FOR OUTSIDE CONSTRUCTION

BACKGROUND OF THE INVENTION

1. Field of the Invention

This invention relates to a canopy system for use when performing outside construction work and, in particular, to a collapsible canopy system for use on a sloped roof to protect workers from rain and sun wherein the canopy uses an adjustable canopy support pole bracket which bracket is secured to the roof and the bracket adjusted to secure the canopy support poles in an upright position.

2. Description of Related Art

The performance of outside construction work is subject to the weather ranging from precipitation such as rain and snow to heat especially from exposure to direct sunlight. The problem of working outdoors in the rain or snow is apparent but working outdoors in the direct sunlight is also a problem due to the intense heat and the exposure to harmful sun radiation.

Protection from the weather is especially important for roofers because of the nature of their business where there is no protection from the weather while working and/or it is very difficult to find temporary protection from the weather by finding cover because of the need to leave the roof which requires climbing ladders which is very time consuming and unsafe. Aside from the direct problems caused by the weather for roofers, the roofer also has the additional problem that working on the roof in the sun may affect the quality of the work performed since the roofing materials may crack or break when walking on the roof or when working on the roof.

Roofers now use shingling brackets to provide a level scaffolding surface on which to walk or to provide an angled surface as a support footing on which to leverage against while working on the roof. A typical bracket used as a scaffold is shown in U.S. Pat. No. 15,390. Another scaffolding bracket is shown in U.S. Pat. No. 298,463. Both of the above patents are hereby incorporated by reference.

Bearing in mind the problems and deficiencies of the prior art, it is therefore an object of the present invention to provide a portable canopy system for use on or with a roof when performing outside construction work on the roof or on the side of a building.

A further object of the invention is to provide a bracket for use with a portable canopy system to provide a canopy for use on or in conjunction with roofs.

Still other objects and advantages of the invention will in part be obvious and will in part be apparent from the specification.

SUMMARY OF THE INVENTION

The above and other objects and advantages, which will be apparent to those skilled in the art, are achieved in the present invention which relates in a first aspect to a portable collapsible canopy system for a roof comprising:

- a plurality of canopy support brackets which brackets are secured to the roof in spaced relation to form a canopy covering area and which are adapted and preferably adjustable to hold a canopy support pole in an upright position;
- a corresponding plurality of rigid poles secured to the brackets and disposed in an upright position, each pole having a bracket engaging portion at its lower end and a canopy engaging portion at its upper end; and

- a canopy member preferably of flexible material such as a tarp or a plastic sheet which material is extended over and secured to the upper portion of said poles to form the canopy.

The bracket preferably has a moveable member which is angularly adjustable depending on the slope of the roof and which member is then fixedly positioned and to which moveable member the pole is then fixedly secured thereto. The moveable member of the bracket is preferably a rotating member to which the pole is secured by, for example, inserting the pole in an aperture in the member and which rotating member is fixedly positioned to hold the pole in an upright position.

In a highly preferred canopy support bracket the rotating member of the bracket comprises two opposing mating members, the first member having projections on its inner surface and being fixed to the bracket and a second axially translatable and rotatable member having opposing projections on the surface thereof which projections on the first member and second member mate when the second member is axially moved to contact the first member and which mated members are then secured together to form a desired pole holding position. The preferred bracket has a projection, preferably tubular, associated with the rotatable member for receiving and securing the lower part of the canopy support pole.

In another aspect of the invention, a canopy support roofing bracket is provided as part of a portable collapsible canopy for a roof wherein the bracket is secured to the roof and is adaptable to hold a canopy support pole in an upright position. The bracket preferably has a moveable member, e.g., a rotating member or a hinged member, which member is fixedly positioned to hold and secure the canopy support pole in an upright position.

In a highly preferred canopy support roofing bracket wherein the moveable member is a rotating member, the rotating member comprises two opposing members, the first member having projections on its inner surface and the member being fixed to the bracket and having a bolt axially secured thereto and a second rotatable member which is rotatable and axially moveable on the bolt and which has projections thereon which projections mate with the projections on the first member when the second member is contacted with the first member and which first and second members when mated are secured together in the desired pole holding position. The second member has canopy pole support engaging means which is preferably a projection on the moveable member which projection receives and secures a lower end of the canopy support pole and which canopy pole is fixedly secured to the projection. The canopy support poles are preferably telescopic to allow the canopy to be easily positionable at varying height.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
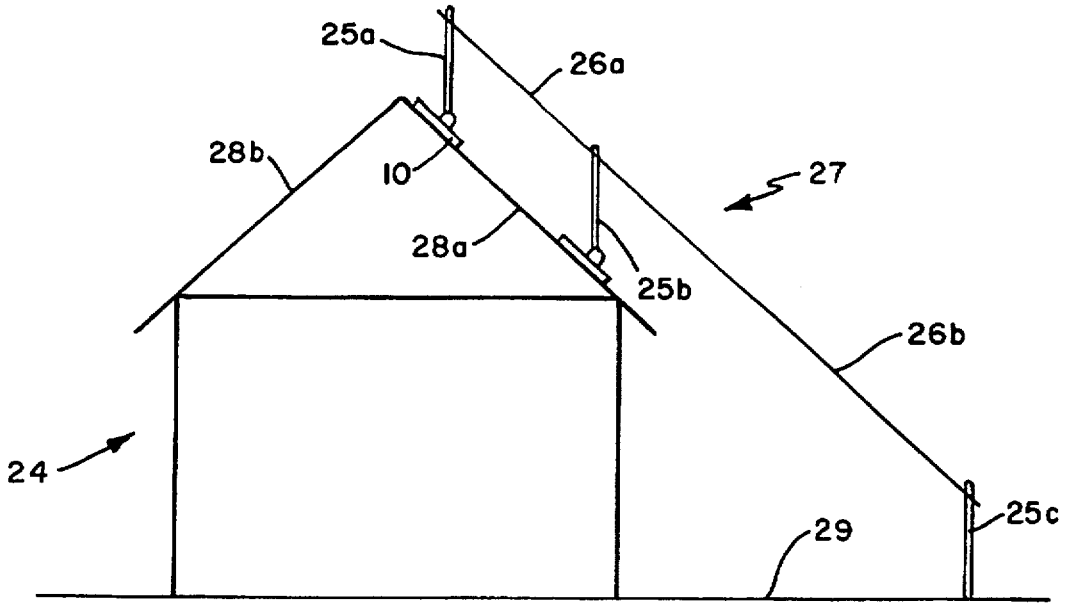
FIG. 1 is a front elevational schematic view of a house showing the canopy system of the invention positioned to cover the roof of the house and also a canopy system covering the ground adjacent the house using a canopy pole positioned in the ground and a canopy pole positioned on the roof using the bracket and canopy system of the invention.

In describing the preferred embodiment of the present invention, reference will be made herein to FIGS. 1–4 of the drawings in which like numerals refer to like features of the invention. Features of the invention are not necessarily shown to scale in the drawings.

FIG. 1 shows a schematic of a house 24 and the canopy system of the invention shown generally as 27. The canopy is shown positioned over both the roof 28 and ground 29 adjoining the house. The house 24 is shown having secured to the roof 28*a* thereof canopy support brackets 10. Canopy support poles 25*a* and 25*b* are secured to the bracket 10 and a canopy 26*a* such as a flexible tarp secured at the upper end of each pole 25*a* and 25*b*. The canopy support poles 25*a* and 25*b*, as well as 25*c* (below) are preferably telescopic so that the height of the pole can be easily adjusted depending on the canopy height desired. Also shown is canopy 26*b* extending over the ground 29. If the canopy system 27 is desired only over the roof 28*a* area, brackets 10 would be secured to the roof 28*a* by, e.g., nailing, and poles 25*a* and 25*b* (other brackets and poles to cover the desired canopy areas are not shown) secured to the brackets and the poles fixedly secured in a substantially upright position. Canopy 26*a* would then be secured to the upper ends of the pole 25*a* and 25*b* typically by wingnuts. If the canopy system 27 is desired only over the ground area 29, a bracket 10 and a canopy support pole 25*b* would be used in conjunction with a canopy support pole 25*c* secured in the ground and the canopy extended between the upper ends of poles 25*b* and 25*c* as shown, (other poles and brackets not shown). It is also contemplated within the invention that canopy support bracket 10 may be positioned on the side wall of the house to provide canopy supporting pole means which can be used to position the canopy over the roof of the house and/or over the ground surrounding the house.

The canopy support brackets may also be secured to both sides 28*a* and 28*b* of the roof for certain desired canopy configurations.

Figure 2:
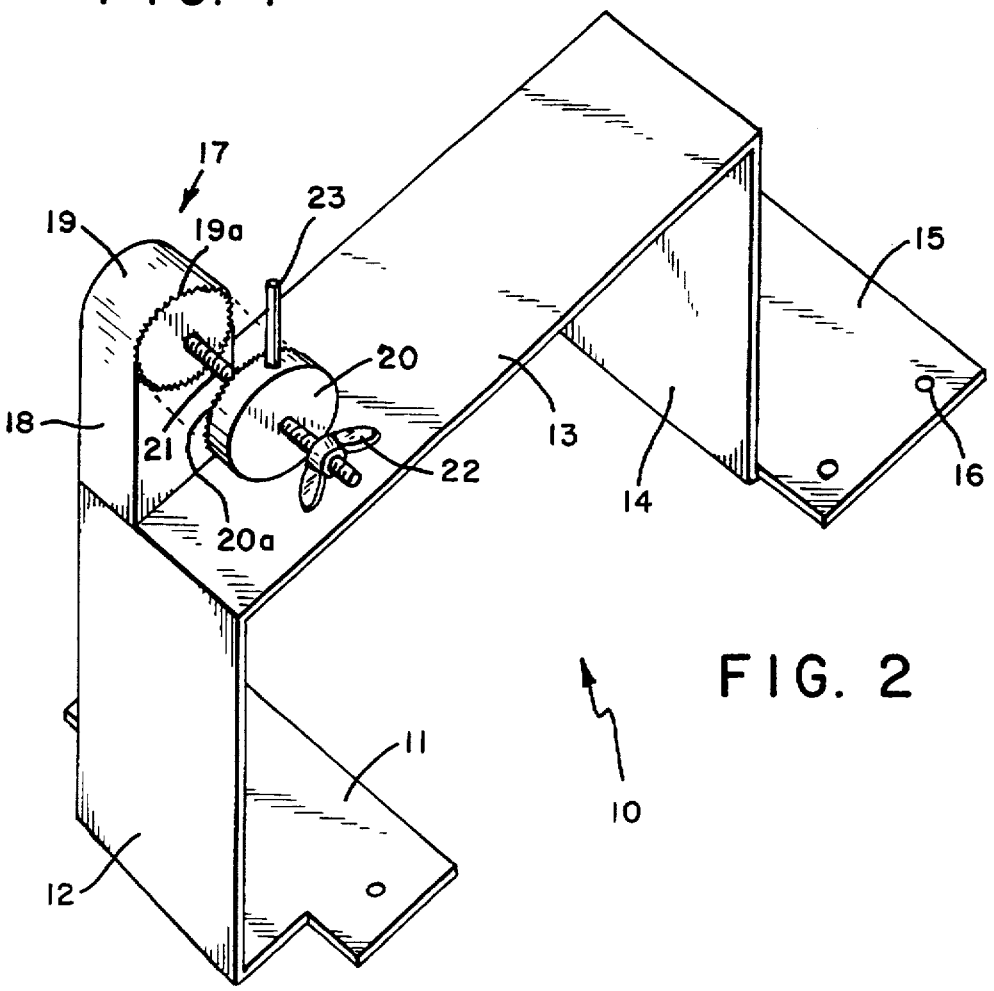
FIG. 2 is a perspective view of a preferred canopy support bracket for use in the canopy system of the invention.

With reference to FIG. 2, a preferred canopy support pole bracket of the invention is shown generally as 10. The bracket 10 has a rectangular flat planar rear base plate 11, a rectangular rear upright connecting leg section 12, a flat planar bracket connection section 13, a rectangular front connecting upright leg portion 14 and a rectangular flat planar front base plate 15. Base plates 15 and 11 are preferably substantially coplanar. The bracket 10 is secured to the roof by preferably positioning base plates 11 and 15 under roofing tiles, preferably vertically adjoining, and nailing nails through base plate openings 16. The bracket is generally made from any structural material and is preferably a metal such as steel, aluminum, etc. Plastic may also be used as well as combinations of metal and plastic.

On the upper surface of bracket connection section 13 a pole mounting support member is shown generally as 17. The member 17 is shown comprising a support 18 and an integral circular member 19. The support 18 is fixedly connected at its base to the upper surface of connecting section 13. The circular member 19 has styrations or other projections 19*a* on the inner surface thereof. A corresponding moveable member 20 having styrations or other projections 20*a* on the opposing surface thereof is axially moveable over bolt 21 which is centrally and axially secured to member 19. Moveable member 20 is also rotatable and rotated to the desired canopy pole holding position and axially moved over bolt 21 until projections 20*a* contact and mate with circular member 19 and opposing projections 19*a*. Moveable member 20 is secured to fixed circular member 19 by wing nut 22. A canopy pole receiving projection 23 is shown integral with moveable member 20 and a canopy pole can be slid over projection 23 and secured thereto.

In using the canopy support bracket 10 to form the canopy system 27 of the invention bracket base plates 15 and 11 are positioned over or, preferably, under vertical proximate roofing shingles and nailed through holes 16 to secure the bracket 10 to the roof. Depending on the slope of the roof, rotatable and axially moveable member 20 would be moved and rotated to contact and mate with fixed member 19 so that pole receiving projection 23 is in a substantially upright vertical position. Fixed circular member 19 and moveable member 20 are then fixedly secured together using wing nut 22. The lower end of a canopy supporting pole is then secured to pole receiving projection 23. The projecting member 23 may be a tube or rod, and is preferably radially disposed. A canopy cover would then be positioned at the upper end of the canopy support pole and secured thereto by conventional means such as wing nuts. A number of brackets 10 would be secured to the roof in spaced alignment in the same manner to form the desired canopy configuration. It is preferred that the canopy support poles be telescopic so that the height of the canopy can be varied.

Figure 3:
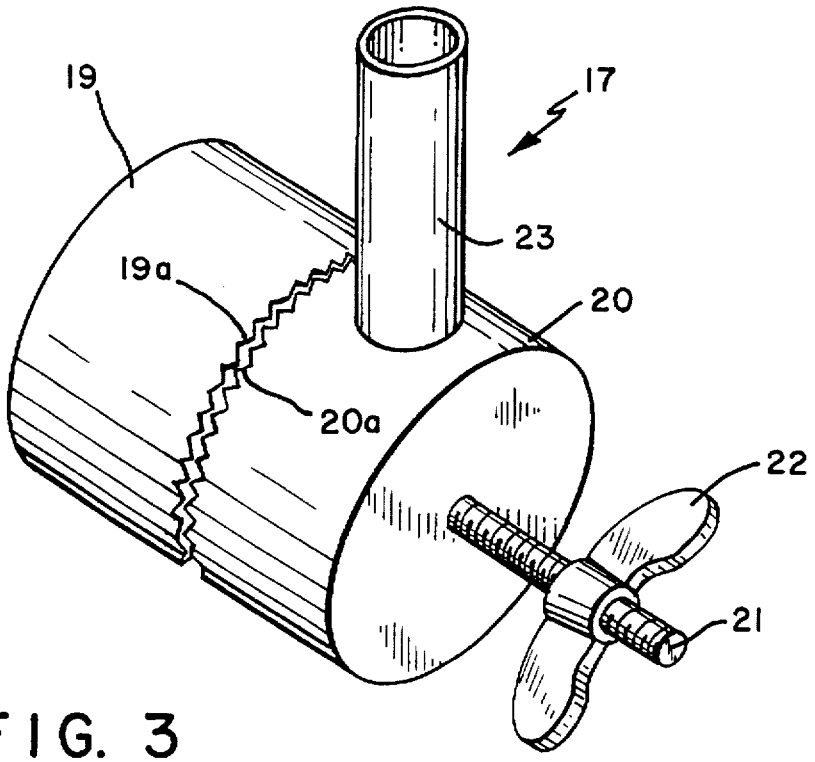
FIG. 3 is a perspective view of the canopy support pole movable members of the preferred roofing bracket of the invention.

FIG. 3 is a perspective view of the preferred pole mounting portion 17 of bracket 10. Thus, fixed member 19 having styrations 19*a* on its inner surface is shown in contact with axially moveable and rotatable circular member 20 having mating opposing styrations 20*a*. When wing nut 22 is tightened against moveable member 20, mounting bracket 17 would be secured in a fixed position. Canopy pole receiving projection 23 is aligned in a substantially upright position for receiving canopy supporting pole members.

Figure 4:
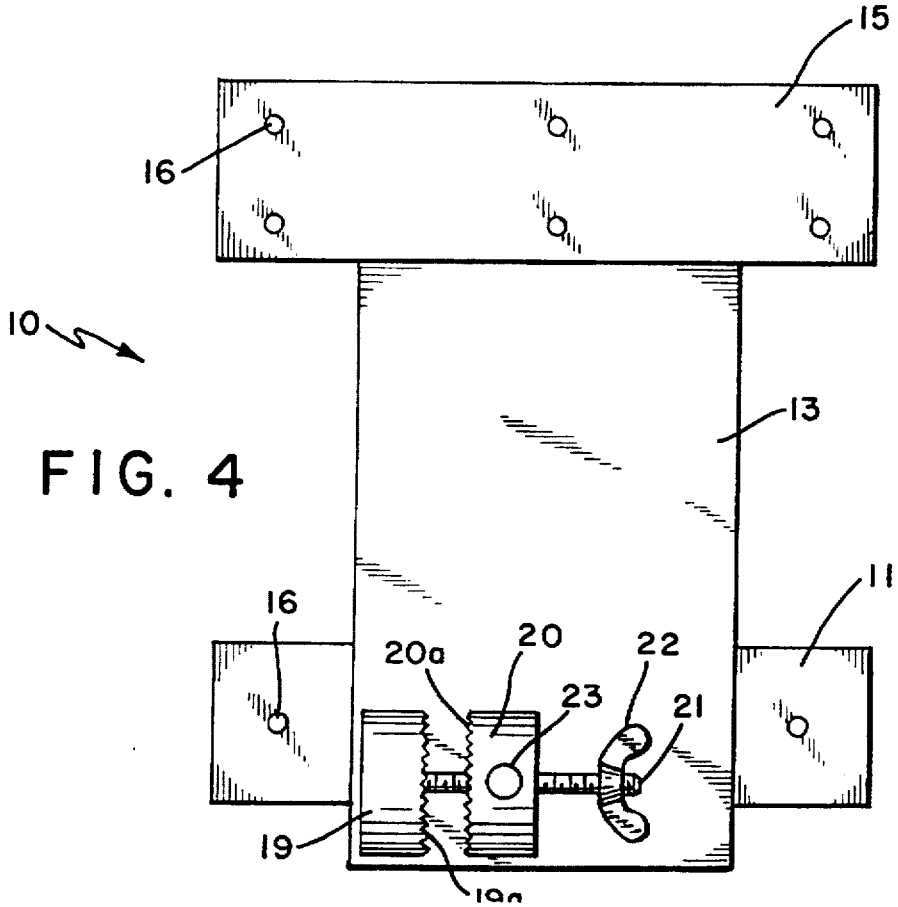
FIG. 4 is a top view of the bracket of FIG. 2.

FIG. 4 shows a top view of the preferred bracket of the invention. Rear base plate 11 and front base plate 15 are shown connected by bracket connection section 13. Openings 16 in both base plates 11 and 15 are used for securing the bracket to the roof by nailing. Fixed member 19 is secured to the upper side of bracket connection section 13 and when axially moveable and rotatable member 20 is axially moved over bolt 21 into contact with fixed member 19 and secured together by wing nut 22, the bracket 10 is ready for receiving a canopy support pole member by pole receiving projection 23.

It is also contemplated herein that existing roofing brackets used for scaffolding or leverage support as noted hereinabove in U.S. Pat. Nos. 15,390 and 298,463 may also be modified and be used to provide a canopy system of the invention. Thus, the shingling bracket of U.S. Pat. No. 15,390, may be adapted to have a canopy support pole projection or other canopy pole securing means as part of the bar (a) which supports the scaffold. Basically, a base member and a hingedly connected bar member are fixedly secured in the desired angle position by an adjustable brace segment and the base member nailed to the roof. A projection on the bar member or opening therein would receive or otherwise secure a canopy support pole.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A portable collapsible canopy for a roof comprising:

a plurality of brackets which brackets are secured to a roof in spaced relation to form a canopy covering area and are adapted to hold a canopy support pole in an upright position;

a corresponding plurality of rigid poles secured to the brackets and disposed in a substantially upright position, each pole having a bracket engaging portion at its lower end and a canopy engaging portion at its upper end;

a canopy member of flexible material extended over and secured to the upper portion of said poles to form the canopy.

2. The portable collapsible canopy for a roof of claim 1 wherein the bracket has a moveable member which is fixedly secured to hold the canopy support pole in a substantially upright position and to which the pole is secured.

3. The portable collapsible canopy for a roof of claim 1 wherein the bracket has a rotatable and axially moveable member to which the pole is secured and which rotatable member is fixedly positioned to hold the pole in an upright position.

4. The portable collapsible canopy for a roof of claim 3 wherein the bracket comprises two opposed mating members, the first member having projections on its inner surface and being fixed to the bracket and a second rotatable and axially moveable member having projections on the opposing surface thereof which projections on the first member and second member mate when the members are in contact and which members are secured together to form a desired position for holding a canopy support pole in an upright position.

5. The portable collapsible canopy for a roof of claim 4 wherein the rotating member has a projection for receiving a canopy pole which is secured to the projection.

6. The portable collapsible canopy for a roof of claim 5 wherein the projection is radially disposed.

7. The portable collapsible canopy for a roof of claim 6 wherein the radial projection is tubular.

* * * * *